US007572082B2

(12) United States Patent
Rouillard

(10) Patent No.: US 7,572,082 B2
(45) Date of Patent: Aug. 11, 2009

(54) BEARINGS FOR THE VIBRATION-CAUSING ASSEMBLY OF A VIBRATING SCREED

(75) Inventor: Roger Rouillard, Charlesbourg (CA)

(73) Assignee: Magic Screed 9033-4624 Quebec Inc., Charlesbourg (CA)

( * ) Notice: Subject to any disclaimer, the term of this patent is extended or adjusted under 35 U.S.C. 154(b) by 268 days.

(21) Appl. No.: 11/187,594

(22) Filed: Jul. 22, 2005

(65) Prior Publication Data

US 2006/0018712 A1 Jan. 26, 2006

(30) Foreign Application Priority Data

Jul. 22, 2004 (CA) ..... 2475525

(51) Int. Cl.
*E01C 19/38* (2006.01)

(52) U.S. Cl. ..... 404/114; 404/118

(58) Field of Classification Search ..... 404/114, 404/118

See application file for complete search history.

(56) References Cited

U.S. PATENT DOCUMENTS

| | | | | |
|---|---|---|---|---|
| 4,386,901 | A | 6/1983 | Morrison | 425/456 |
| 4,832,525 | A * | 5/1989 | Morrison | 404/114 |
| 4,848,961 | A | 7/1989 | Rouillard | |
| 4,861,188 | A | 8/1989 | Rouillard | |
| 5,540,519 | A * | 7/1996 | Weber | 404/102 |
| 5,857,803 | A * | 1/1999 | Davis et al. | 404/102 |
| 6,200,065 | B1 * | 3/2001 | Eitzen | 404/114 |
| 6,231,331 | B1 * | 5/2001 | Lievers | 425/183 |
| 6,296,467 | B1 | 10/2001 | Rouillard | |
| 6,322,286 | B1 * | 11/2001 | Rijkers | 404/114 |
| 6,758,631 | B2 | 7/2004 | Frankeny, II | 404/118 |
| 6,988,851 | B2 | 1/2006 | Sina | 404/114 |
| 7,052,204 | B2 * | 5/2006 | Lutz | 404/118 |
| 7,175,365 | B1 * | 2/2007 | Breeding | 404/113 |
| 7,201,537 | B2 * | 4/2007 | Sina | 404/114 |
| 2006/0018714 | A1 | 1/2006 | Rouillard | 404/114 |

* cited by examiner

*Primary Examiner*—Gary S Hartmann
(74) *Attorney, Agent, or Firm*—Fulbright & Jaworski L.L.P.

(57) ABSTRACT

A vibrating device for surfacing concrete comprising a surfacing blade, a vibration-causing assembly in communication with the surfacing blade and an actuator in communication with the vibration-causing assembly for imparting a vibratory motion to the blade. The vibration-causing assembly comprises a shaft assembly and a bearing assembly in communication with said shaft assembly. The bearing-assembly provides for substantially avoiding undesired movement of said blade during the vibratory motion.

24 Claims, 6 Drawing Sheets

BEARINGS FOR THE VIBRATION-CAUSING ASSEMBLY OF A VIBRATING SCREED

CROSS REFERENCE TO RELATED APPLICATIONS

This application claims priority on Canadian Patent Application CA 2,475,525 filed on Jul. 22, 2004, which is incorporated herein by reference.

FIELD OF THE INVENTION

The present invention relates to vibrating devices or screeds. More specifically the present invention relates to an improved vibrating screed. Still more specifically, the present invention relates to a bearing assembly for the vibration-causing assembly of a vibrating screed.

BACKGROUND OF THE INVENTION

Vibrating devices and more particularly vibrating screeds for surfacing concrete are known in the art, these devices include an elongated surfacing blade mounted transversally at the bottom of a pair of hand-held steering handles with an actuator, such as a motor being adapted to transmit to the blade a vibratory motion. Usually, the motor acts on a vibration-causing device, which is in communication with the blade to impart this vibratory motion.

Examples of such devices inlcude U.S. Pat. No. 4,861,188 issued to Rouillard Aug. 29, 1989, U.S. Pat. No. 4,848,961 issued to Rouillard on Jul. 18, 1989, and U.S. Pat. No. 6,296,467 issued to Rouillard on Oct. 2, 2001.

A drawback of the prior art vibrating screeds is that the vibration-causing device causes undesired movements to the blade that do not allow for smooth surfacing.

Another drawback of the prior art is that the junction between the actuator and the vibration-causing assembly is often damaged by concrete accidentally entering this junction during the surfacing operation.

A further drawback of the prior art is that the handles are not of a convenient height for a variety of users.

OBJECTS OF THE INVENTION

An object of the present invention is to provide an improved vibrating device for surfacing concrete.

Another object of the invention is to provide a vibrating device having a vibration-causing assembly with a bearing assembly so as to substantially avoid undesired oscillating movement of the blade.

SUMMARY OF THE INVENTION

More specifically, in accordance with the present invention, there is provided a vibrating device for surfacing concrete, the vibrating device comprising:

a surfacing blade;

a vibration-causing assembly in communication with the surfacing blade, the vibration-causing assembly comprising a shaft assembly and a bearing assembly in communication with the shaft assembly; and an actuator in communication with the vibration-causing assembly, so as to cause the vibration-causing assembly to impart a vibratory motion to the blade;

wherein the bearing assembly provides for substantially avoiding undesired movement of the blade during the vibratory motion.

In an embodiment, the bearing assembly comprises a double bearing assembly. In an embodiment, the double bearing assembly comprises a first bearing mounted to one end of the shaft assembly and a second bearing mounted to an opposite end of the shaft assembly. In an embodiment, the first and second bearings are top and bottom bearings respectively. In an embodiment, the first bearing is mounted between two shoulder structures formed at one end of the shaft assembly and the second bearing is mounted between another two shoulder structures formed at an opposite end of the shaft assembly.

In an embodiment, the actuator comprises a motor in communication with a transmission connecting the motor to the vibration-causing assembly. In an embodiment, the transmission comprises an axle in communication at one end thereof to the motor and in communication at an opposite end thereof to the shaft assembly. In an embodiment, the axle is in communication with the motor via a drive shaft. In an embodiment, the axle comprises a resilient flexible axle, the motor acting on the flexible axle causing the undesired movement. In a further embodiment, the undesired movement comprises a wiggling movement.

In another embodiment, the undesired movement comprises an undesired oscillating movement that prevents smooth surfacing of the concrete. In a further embodiment, the undesired movement comprises a wiggling movement.

In an embodiment, the vibration-causing assembly comprises counterweight body in communication with the blade. In an embodiment, the counterweight body defines a housing enclosure for housing the shaft assembly therein.

In an embodiment, the device further comprises a steering assembly in communication with the blade. In an embodiment, the steering assembly comprises a handle assembly, the handle assembly comprising at least one arm in communication with the blade. In an embodiment, the at least one arm comprises telescoping portions, the telescoping portions are moveable relative to each other so as to vary the length of the arm. In an embodiment, the at least one arm comprises first and second telescoping portions, the first telescoping portion comprising a free end having a handle and being moveably connected to the second telescoping portion at its opposite end, the second telescoping portion being in communication with the blade at the bottom end thereof.

In an embodiment, the at least one arm comprises a locking assembly for locking at least one of the telescoping portions into position with another adjacent telescoping portion. In an embodiment, at least one of the telescoping portions is a smaller portion, another adjacent portion being a larger portion, the smaller portion being slidably moveable within the larger portion. In an embodiment the locking assembly comprises a tightening member about an opening of the larger portion receiving the smaller portion therein, the locking assembly further comprising a cam for acting on the tightening member so as to so tighten the tightening member as to lock the smaller portion into a given position relative to the larger portion. In an embodiment, the tightening member is a ring-member formed at the opening of the larger portion. In an embodiment, the locking assembly further comprises a lever; the lever is configured to actuate the cam so as to either tighten the tightening member thereby locking the smaller portion or to loosen the tightening member thereby releasing the smaller portion so as to be moveable relative to the larger portion.

In an embodiment, the handle assembly comprises two arms. In an embodiment, the at least one of the two arms comprises a free end with a controller linked to the actuator for control thereof. In an embodiment, the controller comprises a throttle handle.

In an embodiment, the at least one arm comprises one end in communication with the blade and an opposite free end having a handle. In an embodiment, the handle comprises a grip member. In an embodiment, the one end is connected to a vibration-resistance member in communication with the blade and providing to substantially avoid the vibratory motion from being transmitted to the arm. In an embodiment, the vibration-resistance member is in communication with the vibration-causing assembly. In an embodiment, the vibration-resistance member is connected to a plate member in communication with the vibration-causing assembly. In an embodiment, the plate member is in communication with the blade. In an embodiment, the vibration-resistance member comprises a backing member having a top portion connected to the at least one arm and a bottom portion connected to the plate member. In an embodiment, the vibration-resistance member comprises a backing member.

In an embodiment, the device further comprises a seal member for sealing a junction between the actuator and the vibration-causing assembly.

In an embodiment, the actuator is in communication with the vibration-causing assembly via a transmission, connected therebetween, the seal member sealing this transmission.

In an embodiment, the actuator comprises a driving assembly in communication with the vibration-causing assembly, the seal member being mounted about the driving assembly. In an embodiment, the driving assembly comprises a driving shaft in communication with an axle, the seal member sealing the axle. In an embodiment the axle comprises a flexible axle. In an embodiment, the seal member is mounted about the flexible axle.

In an embodiment, the seal member comprises a material that provides for the vibration-causing assembly to impart the vibratory motion to the blade. In an embodiment, the seal member comprises resilient flexible material. In an embodiment, the flexible material is selected from the group consisting of rubber and plastic. In an embodiment, the seal member comprises top and bottom portions and a middle portion therebetween. In an embodiment, the seal member comprises a ring-like configuration.

In an embodiment, the actuator is housed within an actuator housing, the vibration-causing assembly comprising a counterweight body, the seal member top portion being in communication with the actuator housing, the seal member bottom portion being in communication with the counterweight body. In an embodiment, the actuator housing comprises a top plate portion extending therefrom, the counterweight body comprising a bottom plate portion extending therefrom, the seal member top portion being mounted to the top plate portion, the seal member bottom portion being mounted to the bottom portion. In an embodiment, the seal member top and bottom portions comprise respective mounting elements. In an embodiment, these mounting elements comprise protruding fasteners, the top and bottom plate portions comprising respective apertures corresponding to the protruding fasteners.

In an embodiment, the seal member is mounted between two opposite plate portions of a plate member. In an embodiment, the plate member is in communication with the vibration-causing assembly. In an embodiment, the vibration causing assembly comprises a counterweight body connected to the plate member. In an embodiment, the counterweight body is in communication with the blade. In an embodiment, the counterweight body is connected to an elongate vibrating member being connected to the blade. In a further embodiment, the plate member is in communication with the blade. In an embodiment, the plate member is connected to an elongate vibrating member connected to the blade. In an embodiment, the vibration-causing assembly is connected to the vibrating member. In an embodiment, vibration-causing assembly comprises a counterweight body, the counterweight body is connected to the vibrating member.

Other objects, advantages and features of the present invention will become more apparent upon reading of the following non restrictive description of embodiments thereof, given by way of example only with reference to the accompanying drawings.

BRIEF DESCRIPTION OF THE DRAWINGS

In the appended drawings where like elements are referenced by like reference numerals and in which.

DESCRIPTION OF THE EMBODIMENTS

With reference to the appended drawings embodiments of the invention will be herein described so as to exemplify the invention only and by no means limit the scope thereof.

Figure 1:
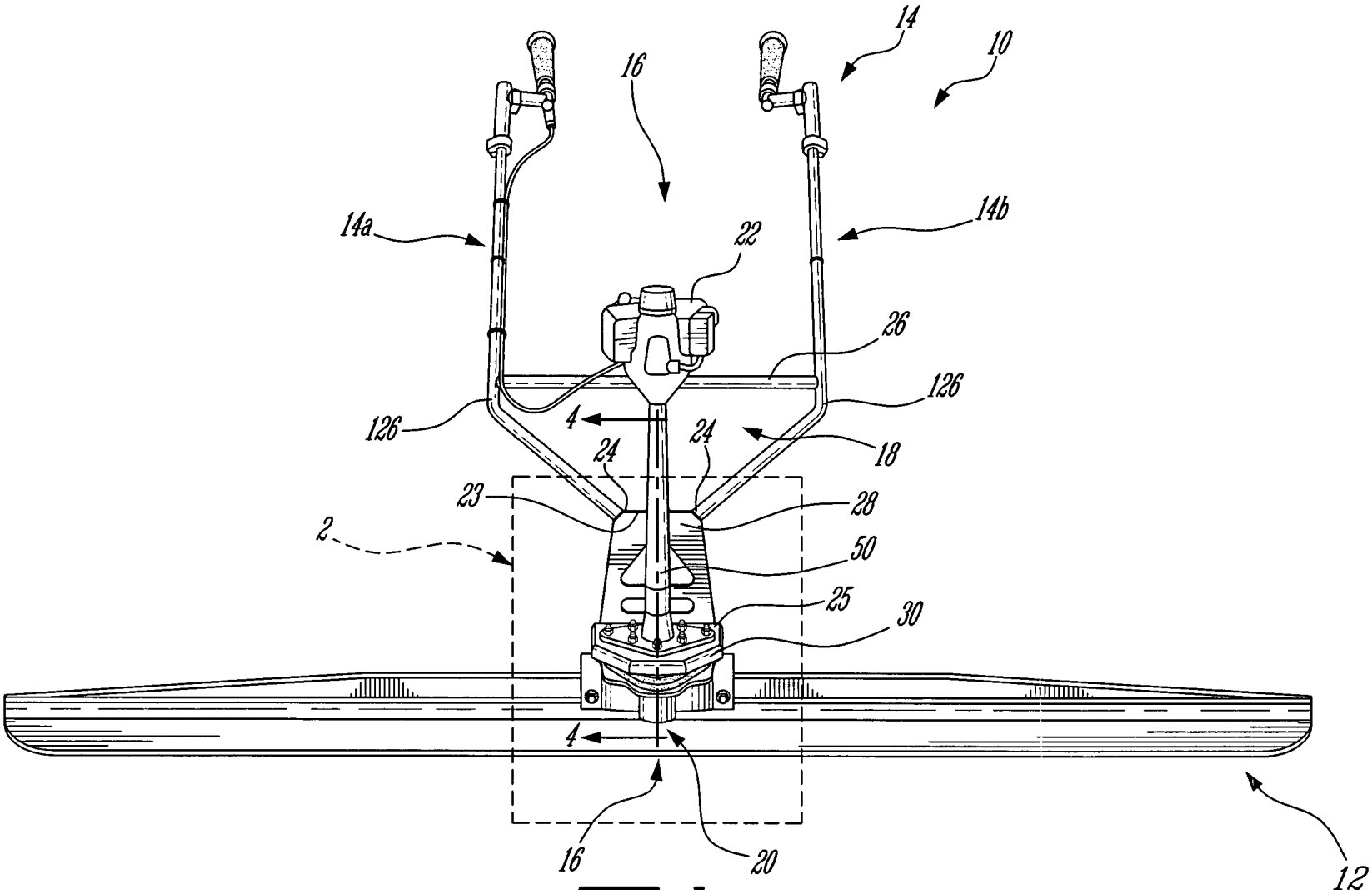
FIG. 1 is a front elevational view of a vibrating screed, in accordance with an embodiment of the present invention.

FIG. 1 illustrates a vibrating device or vibrating screed 10 in accordance with an embodiment of the present invention.

Apart from the invention disclosed and the various embodiments thereof, vibrating screed 10 bears some similarity to the vibrating screed of U.S. Pat. No. 6,296,467, which is incorporated herein by reference.

The vibrating screed 10 comprises an elongated surfacing blade 12, a steering assembly 14 in communication with the blade 12, an actuator/vibration-causing assembly 16 in communication with blade 12 for imparting a vibratory motion thereto, as will be described herein, such that, when the blade 12 is displaced over a not yet set concrete surface (not shown), it surfaces or smoothens, this concrete surface.

The actuator/vibration-causing assembly 16 includes an actuator 18 in communication with a vibration-causing assembly 20. The actuator 18 includes a motor 22. The skilled artisan will appreciate that motor 22 may be powered by gasoline or other fuels and may also be electric.

The steering assembly 14 comprises a pair of handle assemblies 14*a* and 14*b* extending upwardly and rearwardly from the blade 12 and being spaced apart along the orientation of the blade 12. The handle assemblies 14*a* and 14*b* are in communication at their bottom ends 24 with the blade 12 via the actuator/vibration-causing assembly 16 and are further attached together by a cross bar 26. Lower ends 24 are mounted to a vibration-resistance member 28 in the form of a backing panel that substantially avoids the aforementioned vibratory motion from being transmitted to the handle assemblies 14*a* and 14*b*. Backing panel 28 is in communication with a plate member 30 that is in communication the blade 12. In another embodiment, the backing panel 28 may also be spaced apart from plate member 30 and mounted directly to the blade 12.

Figure 2:
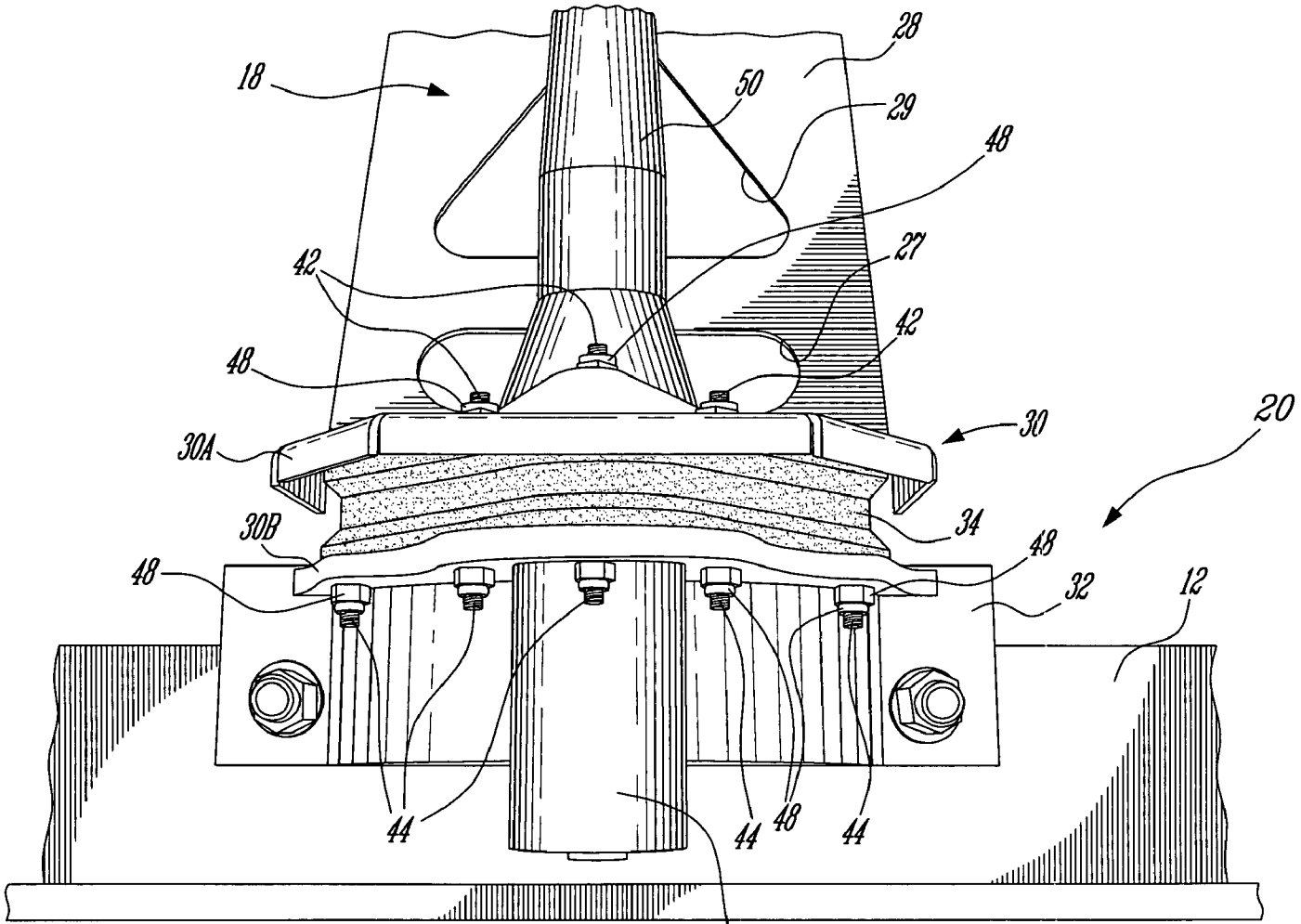
FIG. 2 is a front elevational view of portion 2 of FIG. 1.

The vibration-resistance member 28, shown in FIGS. 1 and 2, has a large surface for absorbing vibes emanating from the vibration-causing assembly 20. The vibration-resistance member 28 includes holes 27 and 29, which provide for making the panel 28 lighter as well as interrupting the vibration flow emanating from the vibration-causing assembly 20. Of course a variety and a plurality of such holes, apertures, pores, opening, or indentations can be provided. In another embodiment, the member 28 is a solid piece of material. The vibration-resistance member 28 includes a top end 23 connected to the steering assembly 14 and a bottom end 25 mounted to the actuator/vibration-causing assembly 16.

With reference to FIG. 2, plate 30 includes top and bottom plate portions 30A and 30B respectively. The top plate portion 30A is mounted to the backing panel 28 and the bottom plate portion 30B is mounted to an elongate vibrating member 32, which is mounted to the blade 12.

A seal or sealing member 34 is sandwiched between the top and bottom portions 30A and 30B, respectively, of the plate member 30.

Figure 3:
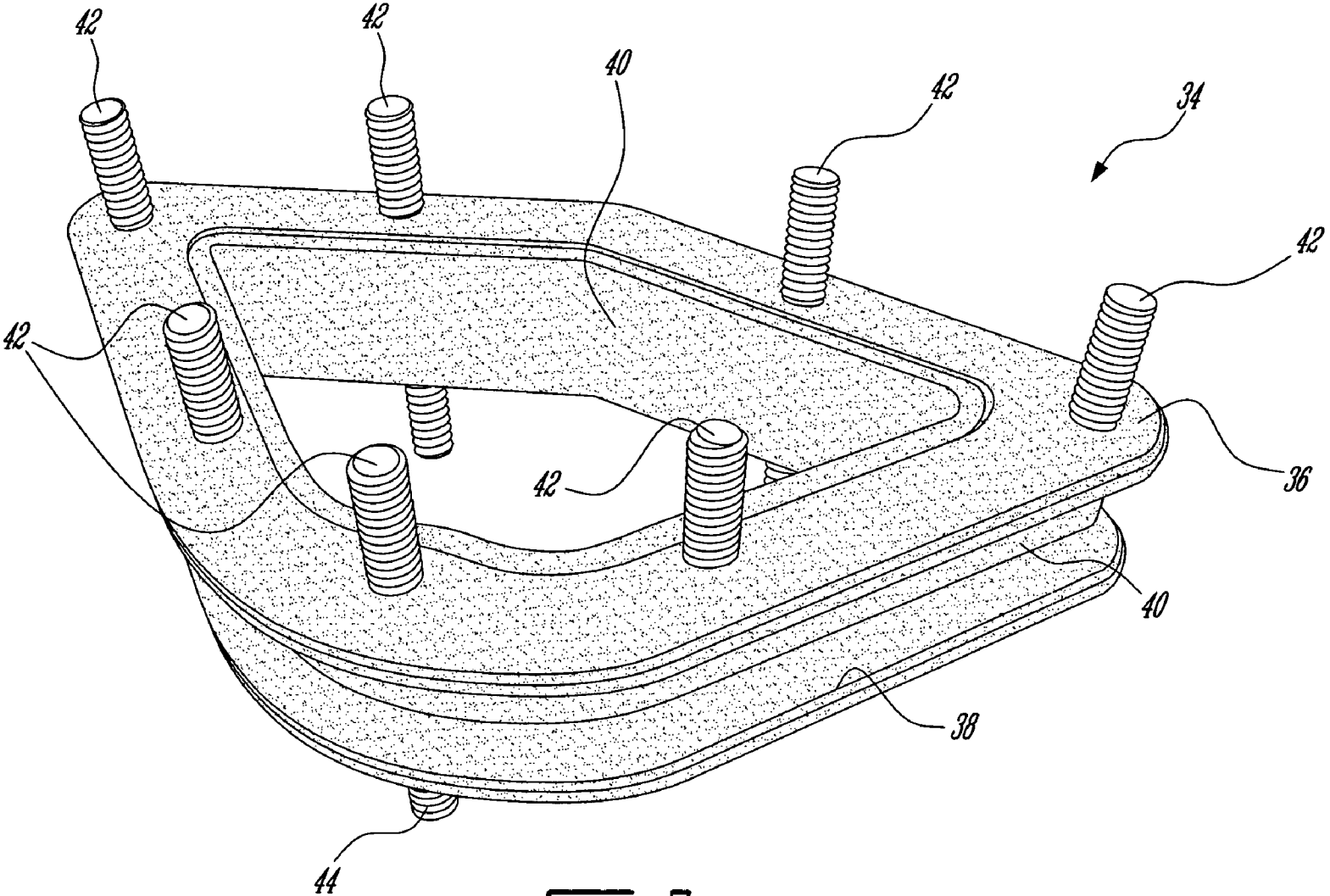
FIG. 3 is a perspective view of a flexible seal in accordance with an embodiment of the present invention.

As better shown in FIG. 3, seal member 34 has a ring-like configuration emulating the shape of plate 30 and includes top and bottom portions 36 and 38, respectively, and middle portion 40 therebetween. The top portion 36 includes top fastening members, such as screws 42 and the bottom portion 38 includes fastening members, such as screws 44. As shown in FIG. 2, the top and bottom fastening members 32 and 34 serve to be mounted, via bolts 46 to the top and bottom plate portions 18A and 18B respectively.

The flexible seal 24 is made of a variety of resilient flexible material as will be understood by the skilled artisan.

The flexible seal provides for sealing a junction of the actuator 18 and the vibration causing assembly 20 as will be detailed below.

Returning to FIG. 1, the actuator 18 includes an actuator housing 50 on which motor 22 is mounted; the housing 50 is in communication with the plate member 30.

Figure 4:
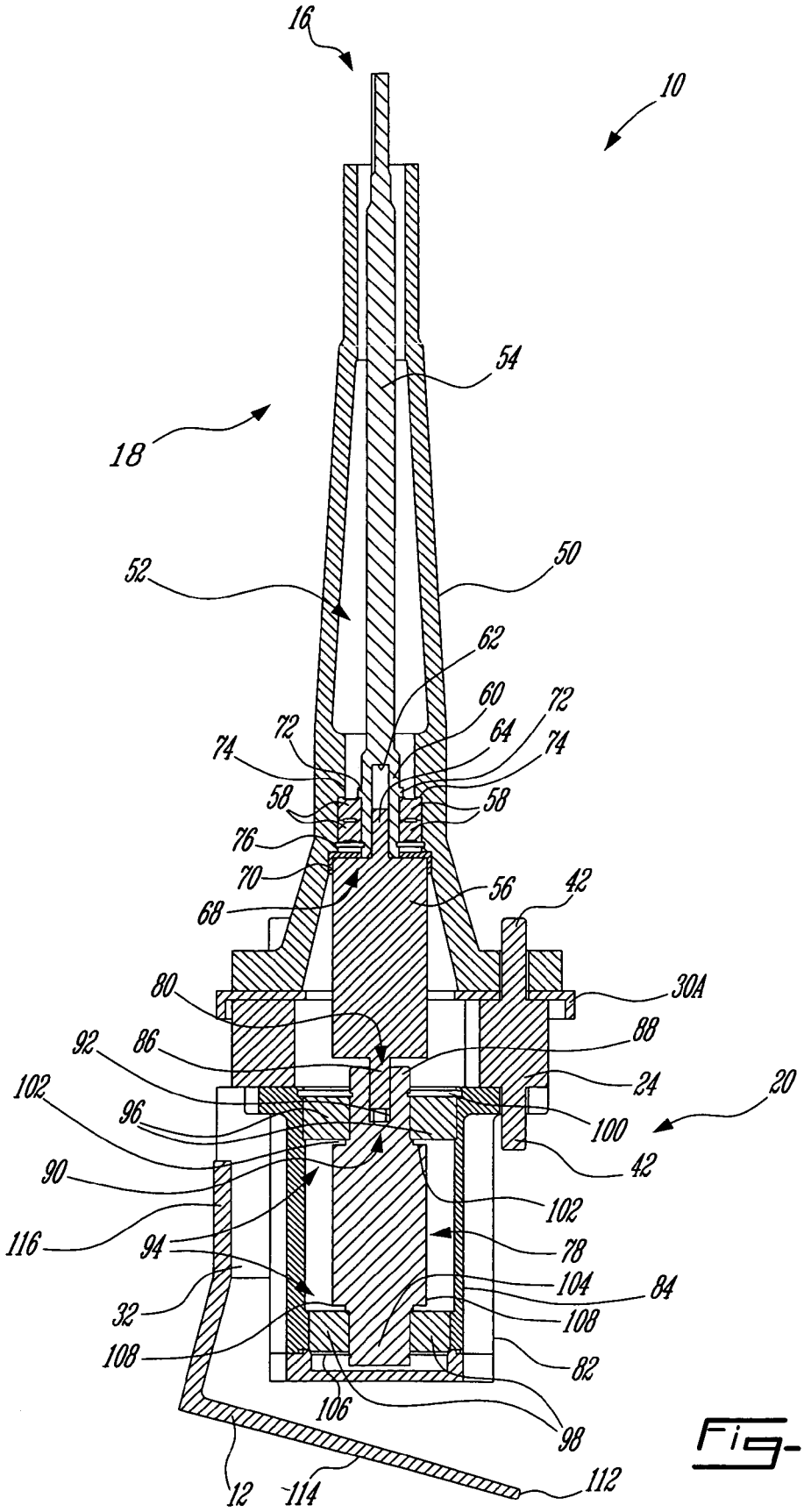
FIG. 4 is a cross-section view taken along line 4-4 of FIG. 1.

As shown in FIG. 4, the actuator 18 and the vibration-causing assembly 20 are connected at their junction via a transmission 56. In this example, the transmission 56 is an axle. Hence, the actuator 18 comprises a motor 22 connected to a driving assembly 52; the driving assembly 52 includes a drive shaft 54 and the axle 56 which are in communication. The drive shaft 54 extends within the actuator or shaft housing 50 and is rotatably driven by the motor 22 and supported in the housing 50 by bearings 58 at its bottom portion 60.

The drive shaft 54 is mounted to the axle 56 at its bottom portion 60. Axle 56 is a resilient flexible axle member. This bottom portion 60 defines a receiving-bore 62 for receiving therein a connector protrusion 64 extending from the top portion 66 of the resilient flexible axle 56. This bottom portion 60 also includes a cap 70 which is snuggly fitted over the top portion 68 of the resilient flexible axle 56. The bearing 58 are kept in place between top shoulders 72 and 74 extending from the drive shaft 54 and the housing 50 respectively and a bottom disc 76 acting as a shoulder structure that is wedged within corresponding circular recesses defined by the housing 50 and shaft 54.

Of course a variety of driving assemblies that can impart a vibratory motion via a vibration-causing assembly to a blade can be contemplated within the context of the present invention. A variety of transmissions for connecting the actuator 18 to the vibration-causing assembly 20 can also be contemplated within the scope of the present invention.

As will be described herein, the motor 22 and driving assembly 52 is in communication with the vibration-causing assembly 20 via the transmission 56 in the form of axle.

More specifically, the resilient flexible axle 56 is mounted to a shaft assembly 78 at its bottom portion 80. This shaft assembly 78 is mounted within a counterweight body 82 defining housing 84. This bottom portion 80 of the resilient flexible axle 56 includes a connecting protrusion 86 that is fitted within a complementary receiving portion 88 formed on the top portion 90 of the shaft assembly 58 and defining a receiving bore 92. The shaft assembly 78 is supported by a bearing assembly 94, which is a double bearing assembly comprising top bearings 96 and bottom bearings 98. The top bearings 98 surround the receiving portion 88 and are positioned between a top disc 100, acting as a shoulder, and shoulders 102 defined by the shaft assembly 78. The top disc 100 is wedged within and between corresponding circular recesses defined by housing 84 and portion 88. The bottom bearings 98 surround the bottom portion 104 of the shaft assembly 78 and are positioned between a bottom disc 106, acting as a shoulder, and shoulders 108 defined by the shaft assembly 78. The bottom disc 106 is wedged within and between corresponding circular recesses defined within the counterweight housing 84 and portion 104. The counterweight body 82 is capped off at its bottom end by enclosure 110.

Therefore, the vibration-causing assembly 20 includes a shaft assembly rotatably mounted within a counterweight body 82.

Of course, the skilled artisan can contemplate a other ways of mounting the bearing assembly 94 to the shaft assembly 78 by for the purposes of the present invention as described below.

The double bearing system 94 provides for substantially avoiding any undesired oscillating movement, which does not allow for a smooth surfacing of the non-set concrete. This undesired oscillating movement is in many cases a wiggling movement caused during actuation of the drive shaft 54 acting on the resilient flexible axle 56, which acts on the shaft assembly 78 in order to cause vibration of the counterweight body 82, which in turn vibrates the blade 12, via the vibrating member 32. In this way, a more stable surfacing system is provided.

As shown in FIG. 4, the surfacing blade includes a leading edge 112, a surfacing underside 114 for surfacing contact with the concrete and a backing 116 which is mounted to the elongate vibrating member 32, the elongate vibrating member being mounted to the counterweight body 82 and to the bottom plate portion 30B.

The seal member 34, functions to protect the driving assembly 52 at the junction of the actuator 18 and the vibration-causing assembly 20. Therefore, the seal 34 protects transmission 56*t* between the flexible axle 56 as well as the top portion 110 of the shaft assembly 78 from concrete during surfacing, since the small space between plate portions 30A and 30B would cause small particles of concrete to enter damaging the axle 78 and shaft assembly 78. Since the seal 34 is made of flexible material it does not interfere with the vibratory motion imparted to the blade 12, caused by the motor 22 acting on the drive shaft 52, which rotates about its vertical axis thus acting on the flexible axle 56 which in turn actuates the shaft assembly 78 causing the counterweight body 82 to vibrate and to act on the elongate vibrating member 32 which transfers this vibratory motion to the blade 12. The seal 56 being made of flexible material does not interfere with the flow of the foregoing.

Figure 5:
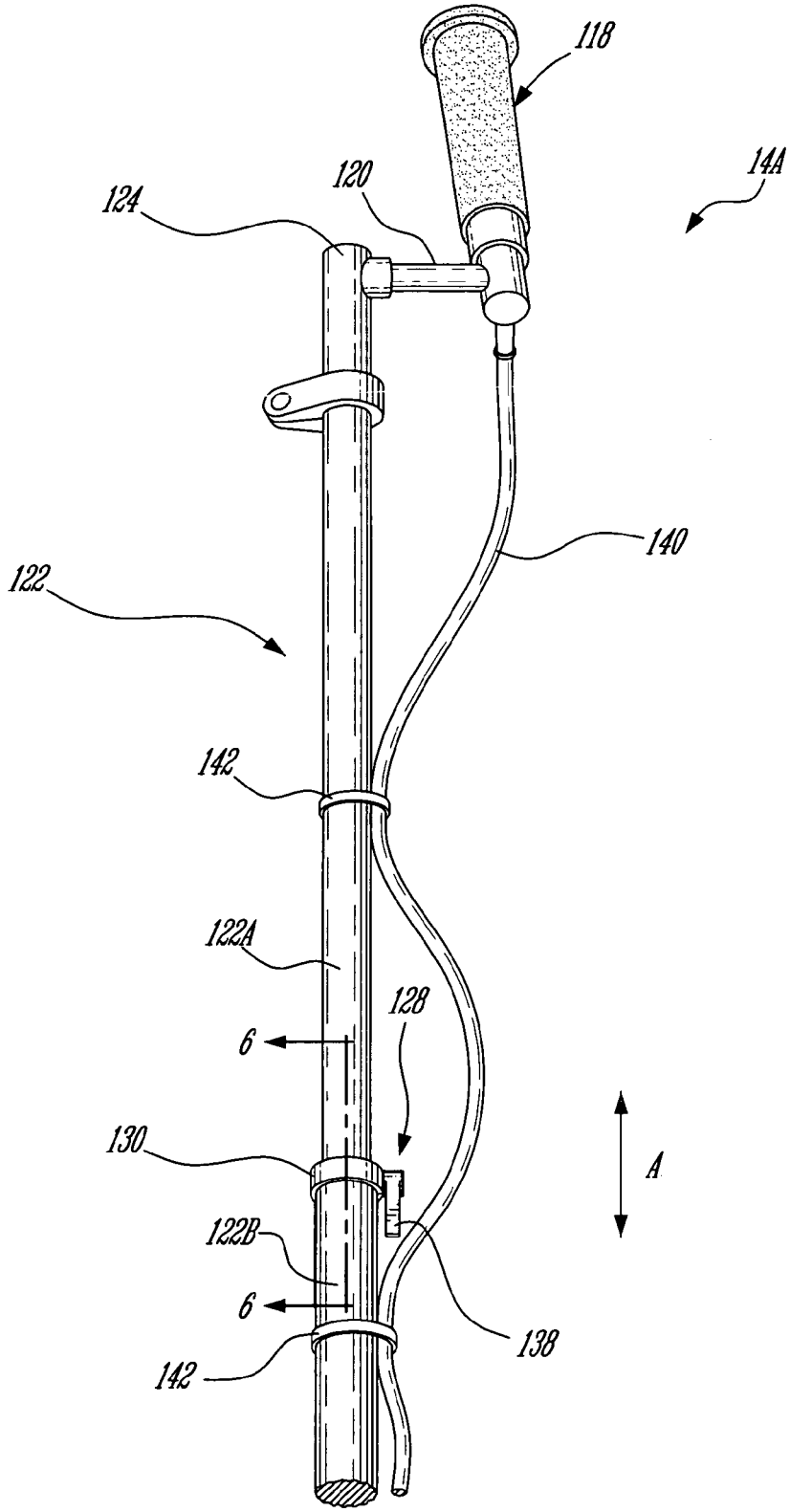
FIG. 5 is a partial front elevational view of a handle assembly of the present invention in accordance with an embodiment thereof.

FIG. 5 shows handle assembly 14*a* of the vibrating screed 10. It should be noted that handle assembly 14*b* is similarly constructed; yet assembly 14*a* will be described herein for concision purposes only.

Handle assembly 14*a* comprises an adjustable grip member 118 mounted via an adjustable connector rod 120 to an adjustable tubular arm 122 at the top free end 124 thereof. The arm 122 is adjustable so as to vary in height as shown by arrow A. In the illustrated embodiment, the arm 122 includes two telescoping tubular portions 122A and 122B, which are slidably mounted to each other for adjusting the height of arm 122. Telescoping portion 122A is smaller and slidably mounted within the larger telescoping portion 122B, which provides for slidably moving the arm portion 122A in an up or down direction, as shown by arrow A. As shown in FIG. 1, the arm portions 122B are elbowed at their respective corners 126 so as to be directed inwardly towards backing plate 28, which their respective bottom ends 24 are mounted to.

Figure 6:
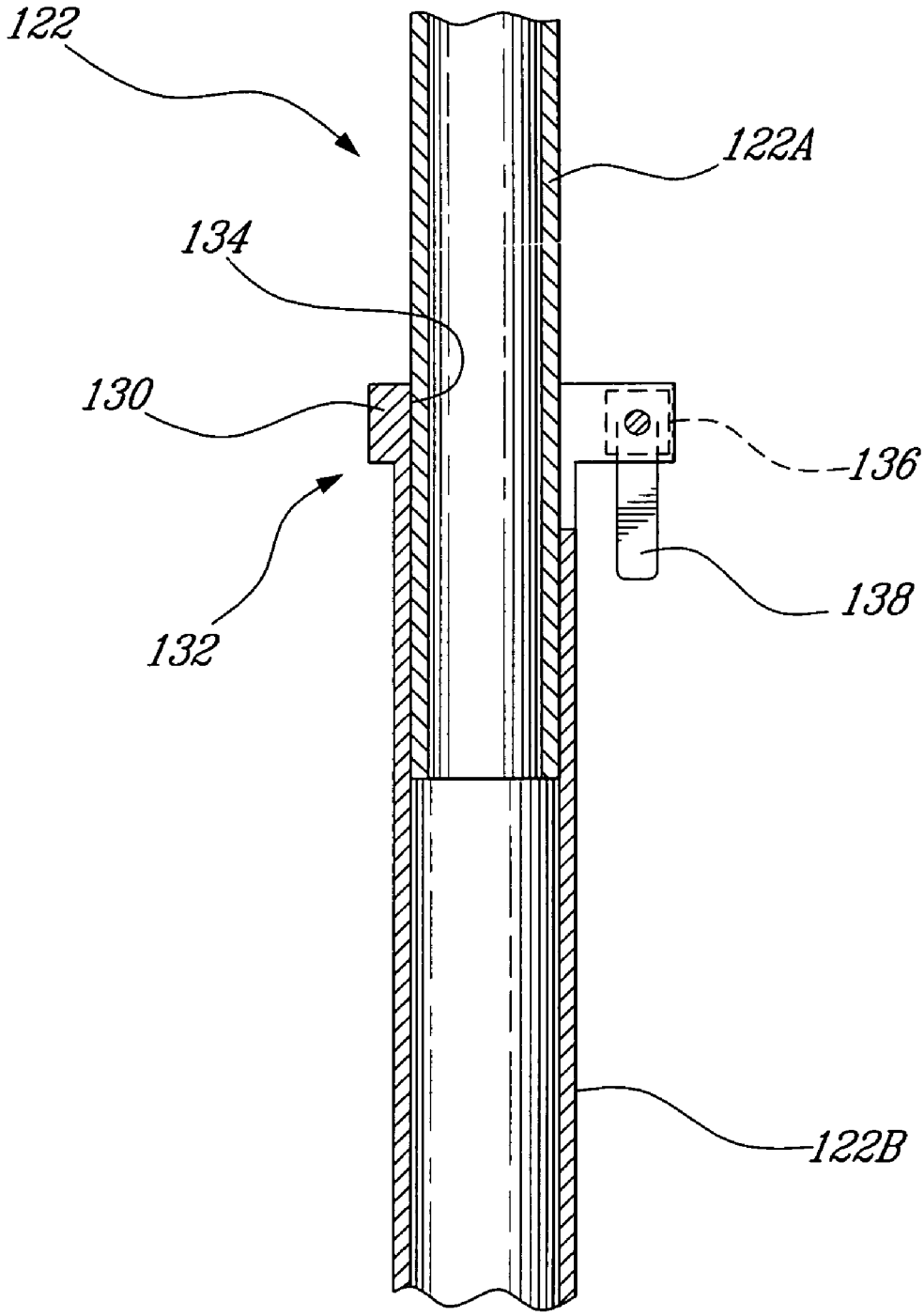
FIG. 6 is a cross-section view taken along line 6-6 of FIG. 5.

As mentioned above and with reference to FIGS. 5 and 6, telescoping tubular arm portion 122A is moveable within tubular arm portion 122B. The movement, as shown by arrow A, of portion 122A within portion 122B, adjusts the height of arm 98. Portion 122A is locked in a desired position via locking assembly 128. Locking assembly 128 includes a tightening portion 130 having a ring-like structure formed the top 132 of tubular arm portion 122B about the opening 134 thereof that receives arm portion 122A. This ring-like portion 130 is tightened via a cam 136 acting thereon. The cam 136 is positioned in an engaging position when moving its connected lever 138 downwards (as shown in FIGS. 5 and 6), thereby tightening the ring-like portion 130, which lockingly grips portion 122A in position; when moving the lever upwards, the cam 106 is in a disengaging position and ceases to act on the ring-like portion 134 which slightly expands in order to allow for the free sliding movement A of portion 122A within portion 122B. The skilled artisan will appreciate that this arrangement is similar to locking mechanisms for adjustable bicycle seats for example.

Of course, arm 122 can be provided in a greater number of telescoping portions and can be locked into a desired height by a variety of mechanisms known in the art.

The grip handle 118 of one of the handle assemblies, in this case assembly 14*a* is provided with a throttle control (not shown), as is known in the art and which is connected to a throttle cable 140 extending to the motor 122. Tie wraps 142 are used to attach the cable 140 to the arm 122.

In operation, the user adjusts the arms 122 to a desired height and locks them via the locking assembly 128. The user then places the surfacing blade 12 onto concrete and presses throttle control, which activates the motor 22 to drive shaft 54 and the flexible axle 56 which acts on the shaft assembly 78 causing the counterweight body 82 to act on the vibrating member 32 which imparts a vibratory motion the blade 12. The user moves the screed 10 along the length of the concrete, surfacing it as the blade 12 vibrates thereon. The seal member 34 protects the flexible axle 56 and the shaft assembly 78 and the junction thereof from the ricochet of concrete particles. The flexible seal 34 also provides for a flexible connection between the top plate portion 30A mounted to the housing 50 and the bottom plate 30B mounted to the counterweight body 82 and as such does not impede the vibratory motion that is imparted to the blade 12. During surfacing, the double bearing 94 avoids the wiggling movement of the shaft assembly 78, which in turn avoids undesired movements of the counterweight body 82 as well as the undesired oscillating movements to the blade 12, via the elongate vibrating member 32. During surfacing, the vibration-resistance member 28 substantially avoids transmitting the vibratory motion to the handle assemblies 14*a* and 14*b*, and thereby to the user.

Keeping the above description in mind, the following is a non-limiting description of various alternative embodiments.

The vibrating screed 10 may comprise a steering assembly 14 that includes one or more handle assemblies such as 14*a* or 14. The handle assemblies can be constructed of various plastic, metallic or other strong and durable materials as is suitable in the art.

The actuator 18 may comprise a variety of motors 22 known in the art and various driving mechanisms for actuating vibration-causing assembly as is known in the art. In the illustrated example, a throttle control with a throttle cable 140 for activating the motor 22 was shown. Of course, motor 22 can be activated by a variety of control mechanisms and be liked via a wire or via remote/wireless linkage to such a control.

The invention is not limited to the vibration-causing assembly 20 described herein but it includes other types of vibration-causing assemblies known in the art.

The elongate vibration member 32 can be provided in a variety of materials, sizes and configurations suitable for transmitting a vibrator motion to the blade 12 and for providing the blade 12 with an agile connection to the screed 10 that allows it to vibrate in accordance with the needs of the user.

A variety of surfacing blades 12 can also be contemplated within the scope of the present invention. Surfacing blades will be selected by the skilled artisan for their performance, durability, width and other factors.

The vibration-resistance member 28 of the invention can be configured in a variety of alternative constructions that provide for avoiding the vibratory motion from the vibration-causing assembly 20 from being transmitted to the steering assembly.

The plate member 30 can also be provided in a variety of sizes and configurations and may include a variety of plate portions, such as 30A and 30B, mounted to one another with flexible seal members, such as 34, mounted between each pair of adjacent portions.

The seal member 34 can be constructed in a variety of ways within the context of the present invention for both sealing the driving assembly 52 and especially the flexible axle 56 from concrete during surfacing. The seal member 34 can be mounted about the junction of the actuator 18 and the vibration-causing assembly 20, or about the driving assembly 52 and especially about the transmission 56 which in the illustrated example is in the form of a resilient and flexible axle 56, by a variety of ways as can be contemplated by the skilled artisan. Hence, the flexible seals of the invention may comprises a variety of fastening or mounting elements depending on the configuration of the bodies which enclose the aforementioned junction, driving assembly 52, transmission an/or the flexible axle 56

The bearing assembly 94 can include a greater number of bearings, of various constructions and configurations, for substantially avoiding any undesired oscillating movement (such as wiggling of the blade), which does not allow for a smooth surfacing of the concrete.

It is to be understood that the invention is not limited in its application to the details of construction and parts illustrated in the accompanying drawings and described hereinabove. The invention is capable of other embodiments and of being practised in various ways. It is also to be understood that the phraseology or terminology used herein is for the purpose of description and not limitation. Hence, although the present invention has been described hereinabove by way of embodiments thereof, it can be modified, without departing from the spirit, scope and nature of the subject invention as defined in the appended claims.

What is claimed is:

1. A vibrating device for surfacing concrete, said vibrating device comprising:

a surfacing blade;

a vibration-causing assembly in communication with said surfacing blade, said vibration-causing assembly comprising:

a counterweight body comprising an upper end and a lower end;

a substantially vertically extending shaft assembly comprising an upper end and a lower end, wherein the shaft assembly is disposed within the counterweight body such that the lower end of the shaft assembly is proximal to the lower end of the counterweight body; and a double bearing assembly in communication with said shaft assembly; and an actuator in communication with said vibration-causing assembly, so as to cause said vibration-causing assembly to impart a vibratory motion to said blade;

wherein said double bearing assembly comprises a first bearing disposed between the shaft assembly and the upper end of the counterweight body and a second bearing disposed between the shaft assembly and the lower end of the counterweight body; and wherein said double bearing-assembly provides for substantially avoiding undesired oscillating movement of said blade during said vibratory motion to achieve smooth surfacing of the concrete.

2. A vibrating device according to claim 1, wherein said first bearing is mounted between two shoulder structures formed at one end of said shaft assembly and said second bearing is mounted between another two shoulder structures formed at an opposite end of said shaft assembly.

3. A vibrating device according to claim 1, wherein said actuator comprises a motor in communication with a transmission connecting said motor to said vibration-causing assembly.

4. A vibrating device according to claim 3, wherein said transmission comprises an axle in communication at one end thereof to said motor and in communication at an opposite end thereof to said shaft assembly.

5. A vibrating device according to claim 4, wherein said axle is in communication with said motor via a drive shaft.

6. A vibrating device according to claim 4, wherein said axle comprises a resilient flexible axle.

7. A vibrating device according to claim 1, wherein said counterweight body is in communication with said blade.

8. A vibrating device according to claim 7, wherein said counterweight body defines a housing enclosure for housing said shaft assembly therein.

9. A vibrating device according to claim 1, further comprising a steering assembly in communication with said blade.

10. A vibrating device according to claim 9, wherein said steering assembly comprises a handle assembly, said handle assembly comprising at least one arm in communication with said blade, said arm being so adjustable as to vary the length thereof.

11. A vibrating device according to claim 10, wherein said at least one arm comprises telescoping portions, said telescoping portions being moveable relative to each other so as to vary the length of said arm.

12. A vibrating device according to claim 10, wherein said handle assembly comprises two said arms.

13. A vibrating device according to claim 10, wherein said at least two arms comprises one end in communication with said blade and an opposite free end comprising a handle.

14. A vibrating device according to claim 12, wherein said handle comprises a controller linked to said actuator for control thereof.

15. A vibrating device according to claim 13, wherein said one end opposite is connected to a vibration-resistance member in communication with said blade and providing to substantially avoid said vibratory motion from being transmitted to said arm.

16. A vibrating device according to claim 15, wherein said vibration-resistance member is in communication with said vibration-causing assembly.

17. A vibrating device according to claim 1, further comprising a seal member for sealing a junction between said actuator and said vibration-causing assembly.

18. A vibrating device according to claim 17, wherein said actuator is in communication with said vibration-causing assembly via a transmission, said seal member mounted about said transmission.

19. A vibrating device according to claim 18 wherein said transmission comprises an axle.

20. A vibrating device according to claim 19, wherein said axle comprises a flexible axle.

21. A vibrating device according to claim 17, wherein said seal member is mounted between two opposite plate portions of a plate member.

22. A vibrating device according to claim 21, wherein said plate member is in communication with said vibration-causing assembly.

23. A vibrating device according to claim 22, wherein said counterweight body is connected to a vibrating member being connected to said blade.

24. A vibrating device according to claim 21, wherein said plate member is in communication with said steering assembly.

* * * * *

UNITED STATES PATENT AND TRADEMARK OFFICE

CERTIFICATE OF CORRECTION

PATENT NO. : 7,572,082 B2
APPLICATION NO. : 11/187594
DATED : August 11, 2009
INVENTOR(S) : Roger Rouillard It is certified that error appears in the above-identified patent and that said Letters Patent is hereby corrected as shown below:

In claim 14, column 10, line 18, delete "12" and insert --13-- therefor.

Signed and Sealed this

Second Day of February, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,572,082 B2
APPLICATION NO. : 11/187594
DATED : August 11, 2009
INVENTOR(S) : Roger Rouillard It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 487 days.

Signed and Sealed this

Seventh Day of September, 2010

David J. Kappos

David J. Kappos
*Director of the United States Patent and Trademark Office*